US006687914B2

(12) United States Patent
Conyers

(10) Patent No.: US 6,687,914 B2
(45) Date of Patent: Feb. 10, 2004

(54) TYCON II REVERSIBLE NECKTIE

(76) Inventor: Tyrone Conyers, 600 Dupree St., Manning, SC (US) 29102

( * ) Notice: Subject to any disclaimer, the term of this patent is extended or adjusted under 35 U.S.C. 154(b) by 3 days.

(21) Appl. No.: 10/246,074

(22) Filed: Sep. 19, 2002

(65) Prior Publication Data

US 2003/0088903 A1 May 15, 2003

Related U.S. Application Data

(60) Provisional application No. 60/329,555, filed on Oct. 16, 2001.

(51) Int. Cl.[7] ..... A41D 25/00
(52) U.S. Cl. ..... 2/144; 2/145
(58) Field of Search ..... 2/144, 145, 146–151, 2/152.1, 153–157; 24/49.1, 54, 65, 66.1

(56) References Cited

U.S. PATENT DOCUMENTS

| | | | | | |
|---|---|---|---|---|---|
| 353,486 | A | | 11/1886 | Eschner | |
| 871,569 | A | | 11/1907 | Davies | |
| 979,521 | A | | 12/1910 | Lyon | |
| 1,598,733 | A | | 9/1926 | Lettre | |
| 3,335,427 | A | | 8/1967 | Eads | |
| 3,506,978 | A | | 4/1970 | Santona | |
| 3,720,958 | A | * | 3/1973 | Cowdrey | 2/146 |
| 3,735,420 | A | * | 5/1973 | New | 2/150 |
| 3,744,057 | A | * | 7/1973 | Luceri | 2/146 |
| 3,953,894 | A | * | 5/1976 | Aron | 2/146 |
| 3,959,825 | A | * | 6/1976 | Hughes | 2/146 |
| 4,656,672 | A | * | 4/1987 | Lande | 2/150 |
| 5,218,722 | A | | 6/1993 | Vandenberg | |
| 5,575,007 | A | * | 11/1996 | Gaffney | 2/144 |
| 6,131,200 | A | * | 10/2000 | McNamara | 2/144 |

* cited by examiner

*Primary Examiner*—Tejash Patel
(74) *Attorney, Agent, or Firm*—Dority & Manning, P.A.

(57) ABSTRACT

This invention concerns a necktie that is reversible. This invention uses a zipper to enable the necktie to reverse. Clear thread defines a fold line, or a crease, that runs vertically down the open and unzipped necktie structure and dually outlines the shape of a standard necktie. The zipper runs down the back of the necktie structure and connects the two flaps that are folded back evenly, as a result of using the clear fold lines. When the structure is unzipped and folded back, it reveals the other color pattern. The zipper is then rejoined on the opposite side and zipped up to reverse the necktie structure.

10 Claims, 4 Drawing Sheets

TYCON II REVERSIBLE NECKTIE

This is a non-provisional patent application of prior provisional patent application No. 60/329,555 filed on Oct. 16, 2001 for which benefit is claimed.

BACKGROUND OF INVENTION

The present invention concerns a new improved necktie that is fully reversible. There have been various necktie structures that have improved the standard necktie and patented in the U.S.A. before, but none of them are believed to anticipate the functions of my new necktie structure. A variety of necktie structures have been the subject of earlier U.S. Patents. In my field of search of U.S. Patent Documents, I found no necktie structures that were similar to my invention in design or function.

My invention is an improvement to the standard necktie in utility function and design.

BRIEF SUMMARY OF THE INVENTION

Objects and advantages of the invention are set forth in part in the following description, or may be obvious from the description, or may be learned through practice of the invention.

According to important features of my invention, the use of a reversible zipper to reverse a necktie structure is original in its utility. One important feature of my new necktie structure involves a reversible zipper that is flexible and durable. This invention incorporates the use of clear or invisible thread to form a fold line or a crease that acts as an indentation to enable the necktie to fold in the same place every time it is reversed.

According to another important feature of my invention, the use of clear thread, invisible thread, or any type of thread to outline the shape of a standard necktie onto a necktie structure, and by doing so enable the necktie structure to fold in the same place every time, is original in its utility.

According to my present invention I have provided a necktie structure that is unique in design and utility. The use of a zipper that is itself reversible enables my invention to be reversed. This invention is zipped up with the desired color or pattern facing outward, and the other pattern of color facing inwards and concealed. When it is desired to wear the then concealed pattern or color, the necktie is then unzipped and then zipped up on the opposite side. Now the once concealed pattern of color can now be worn outward, and the once outward pattern or color is now facing inward and my invention has been reversed. Once the inward pattern is facing outward, and the necktie has been zipped up, the nametag may be secured by rotating the unfastened side up and connecting it. The necktie has been reversed and is ready to be tied and worn.

Another feature of my invention concerns the use of clear or invisible thread to outline the shape of a standard necktie. The clear or invisible thread is used so that the appearance of the pattern or color being used is not compromised by the use of colored thread. The clear or invisible thread also serves as a crease or fold line. The crease or fold line makes an indentation that enables my invention to fold in the same place every time it is reversed.

Still another feature of my invention relates to the use of a tab at its small end. The tab has two buttonholes, one on each side.

A detachable nametag is also used to enable my invention to be zipped up and down without obstruction.

DESCRIPTION OF THE DRAWINGS

FIG. 2 shows where the other pattern or color is seen at the bottom and large end, where on a standard necktie, the interfacing would appear.

DETAILED DESCRIPTION OF THE PREFERRED EMBODIMENT

Figure 1:
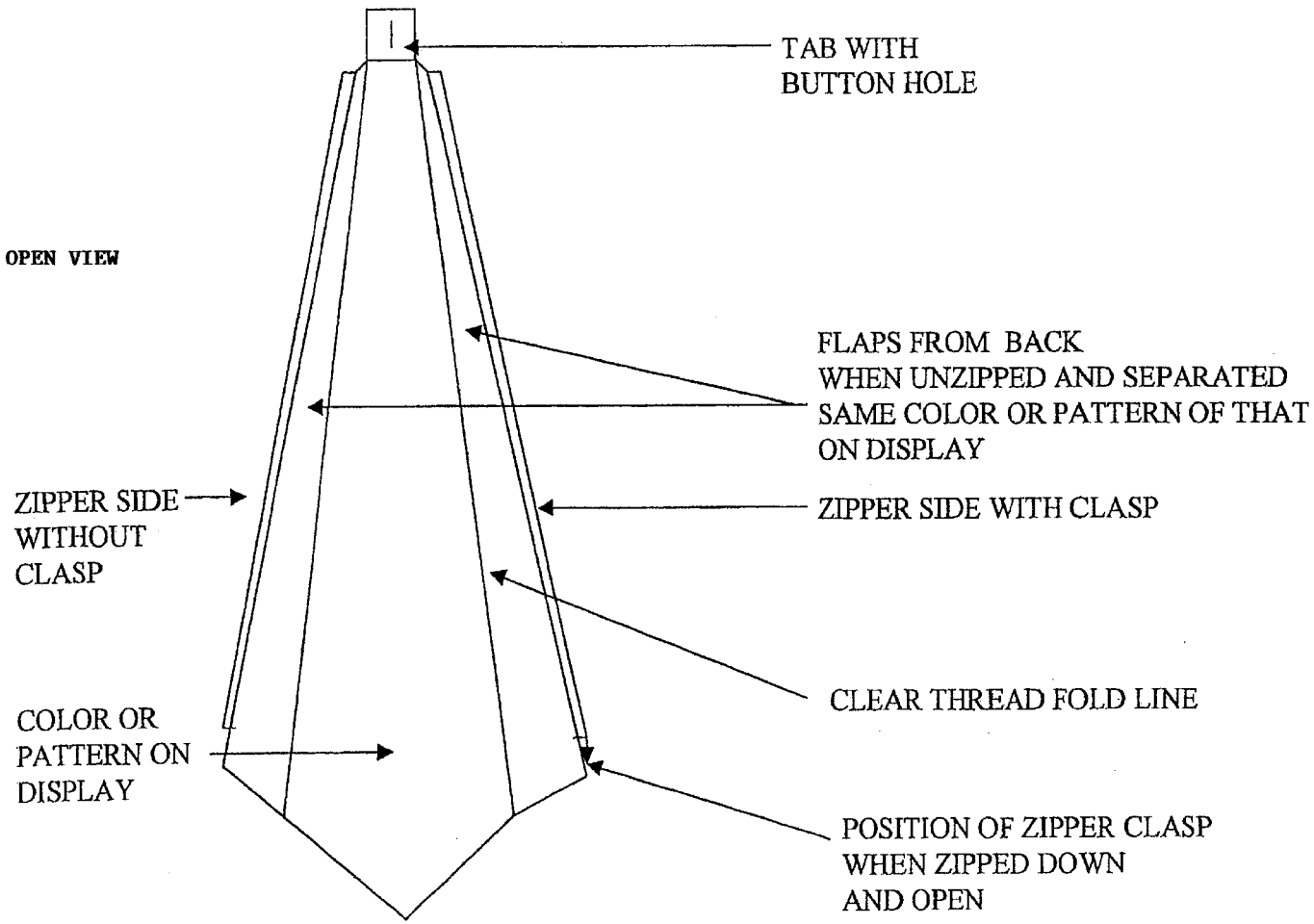
FIG. 1 is the open view of my invention when it is unzipped and opened up. It shows the indentation of the clear or invisible thread and where this necktie structure will fold evenly every time it is reversed. It also shows the zipper when the teeth are facing outward.
Figure 2:
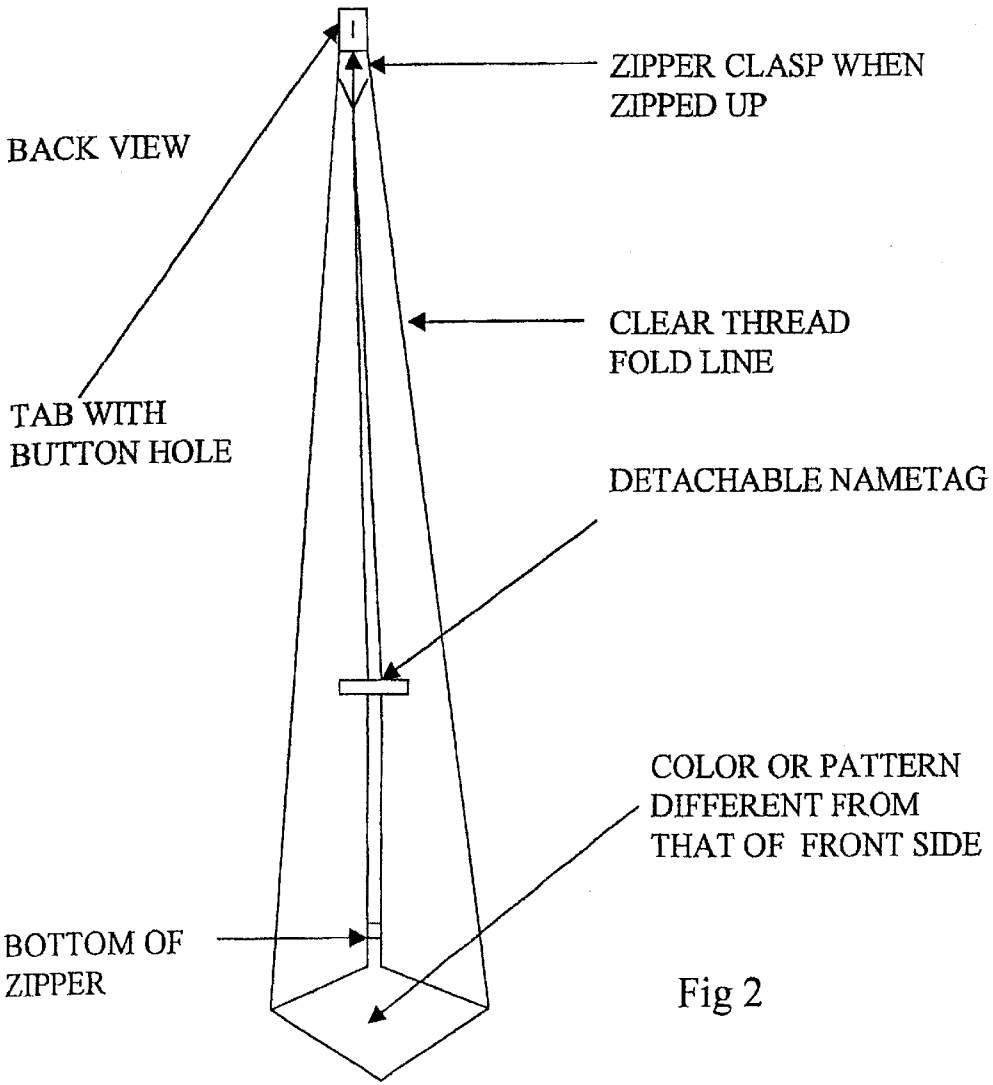
FIG. 2 shows the back view of my invention and how it looks when it is fully assembled zipped up and has the nametag fully attached. It also shows one side of the tab that has two buttonholes, one on the side not shown as well. It also shows how this invention has formed the shape of a standard necktie by being folded on the clear or invisible thread lines.
Figure 3:
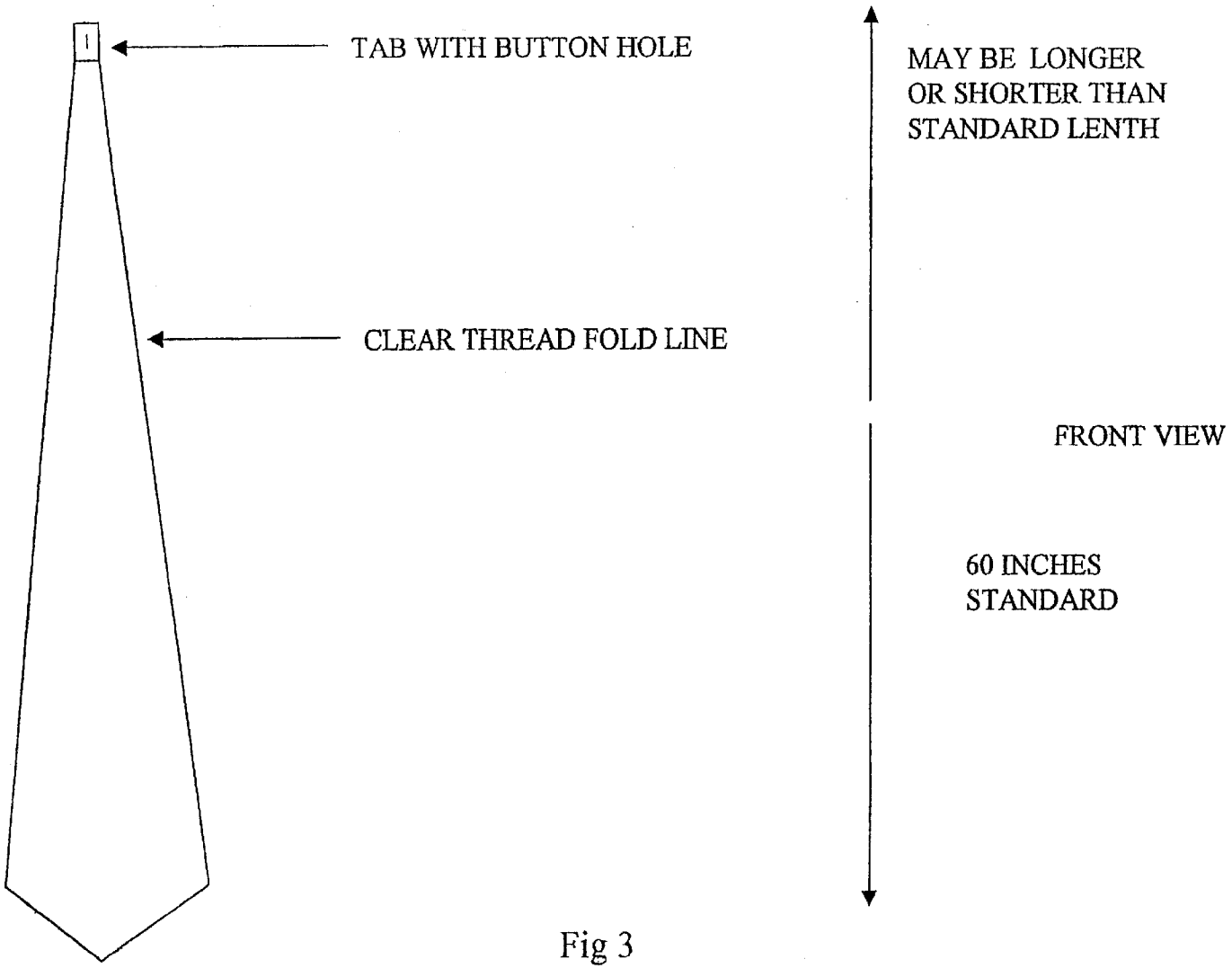
FIG. 3 shows the front view of my invention when it is zipped up and ready to be tied and worn.
Figure 4:
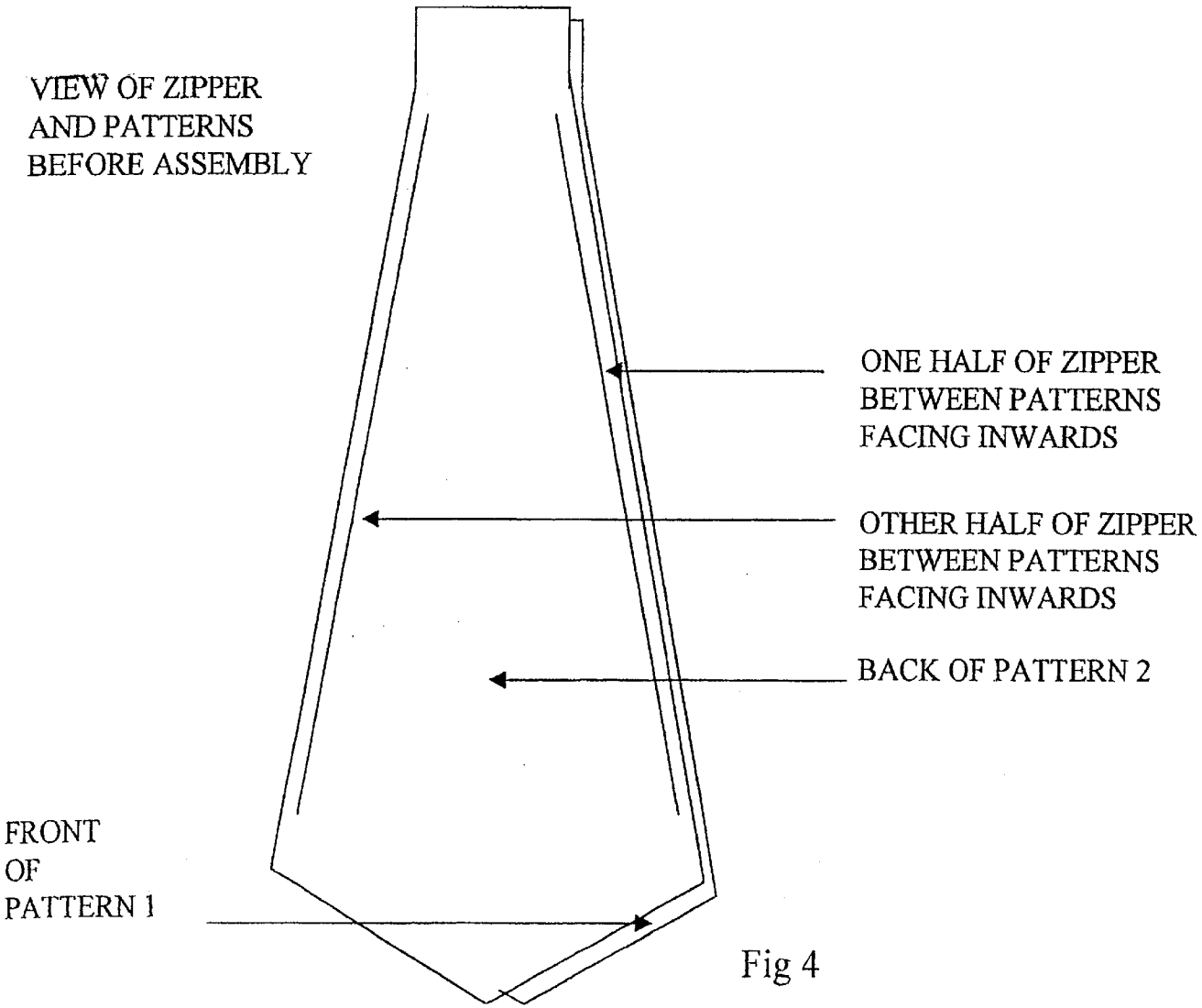
FIG. 4 illustrates how the two patterns or colors are facing each other before they are sewn together; it also shows how the two sides of the zipper are positioned facing inwards and facing each other before sewing.

Reference will now be made to embodiments of the invention, at least one example of which is illustrated in the drawings. It should be appreciated that the embodiments are provided by way of explanation of the invention, and not meant as a limitation of the invention.

According to my invention I have provided a necktie structure that is reversible. This tie is conventional in appearance when worn, except that it has indentations that make clear fold lines that border it when seen from the front or side view. It also has a tab at its small end with two buttonholes. My invention can be made to the standard length of 60 inches or it may be made longer or shorter depending on the demand.

The materials used in my invention are the same as that used in standard neckties (examples include silk or satin); however it does not requiring a lining.

A nylon or plastic zipper is used to reverse this necktie structure. The zipper runs down the center of the back of my invention. A manufacturer or wearer of my invention may save half of the space used for storage. Once this necktie structure is ready to be tied and worn, it is tied in the same fashion of that of a standard necktie.

The nametag is detachable and may be attached by the use of buttons, clasps or hook-and-loop fasteners.

It will be obvious that I have provided a necktie structure that enables the wearer to change tie patterns or colors without searching for a new necktie. A plastic or nylon reversible zipper is used in my invention for its flexibility and durability. Clear or invisible thread is used to make the crease or fold lines that are sewn in the center of the flattened and opened pouch in FIG. 1. My invention forms the shape of a standard necktie when folded back on the fold lines and zipped up.

A reversible zipper, hook-and-loop fasteners, or any other device that may be used to join two sides of the necktie structure together and separate them at will. Buttons or clasps can also be used, however the reversible zipper is the preferred method or device to use to reverse this invention. To reverse my invention, the nametag is detached on one side and swung out of the way of the line of travel of the reversible zipper. The reversible zipper is then zipped down and separated and the necktie structure is opened up and folded back to the opposite side. Once it is folded back on the opposite side, the reversible zipper is reattached and zipped up revealing the other pattern or color that previously was concealed on the inside of this necktie structure. The nametag that was previously on the inside and is now facing outward is now attached, and my invention is ready to be tied and worn.

The reversible necktie structure displays the same color or pattern on the front and back of tie when connected or zipped up, with the other pattern or color concealed on the inside, with the exception of the portion on the back and to the base of the tie, where on a standard necktie the interfacing would appear.

Clear thread is used to make a crease or fold line that enables this invention to fold in the same place every time it is reversed. The fold line, or crease, is used as an indentation so that the tie sits down flat when it is reversed, and is not rounded in appearance. The clear thread serves as a border and also as an indentation outline that shapes this reversible necktie structure when worn on either side. Clear or invisible thread is used because it blends in with the fabric being used.

On the back of my invention is the nametag, which may be removably connected by any of the following: buttons, claps, or hook-and-loop fasteners. The nametag is detachable and therefore needs to be able to be either fully detached, or for one side of it to be detached and swung away so that the reversible zipper can be unzipped and then zipped back up on the opposite side without obstruction.

A thin liner may be used, but it is not necessary to use one, because this invention already has four thin layers of fabric. The standard necktie uses a lining that is usually thicker and heavier than that of the fabric itself, as a result my invention is just as thin as the standard necktie with the exception of the reversible zipper used in my invention. A plastic or nylon coil zipper is the preferred type to be used; it is lightweight and flexible. The length of my invention can be longer or shorter than the standard 60 inches.

On the small end of my invention is a tab with a buttonhole on each side that attaches to the shirt button of the person wearing this necktie structure. There are some standard neckties that use buttonholes on the small end of the tie for this purpose, but non of them use a tab that pivots to the movement of the person wearing the tie. The tab is connected by the use of, for example, buttons or clasps, which enables it to pivot from left to right. Any type of material may be used for the tab, however thin lightweight leather is the preferred material for durability and appearance.

This invention is assembled by sewing two different patterns or colors together. The two sides are sewed with the pattern sides facing each other. The two sides of the reversible zipper are placed on opposite sides of the perimeter of this invention with the teeth of the zipper facing inwards. This invention is thin assembled by sewing around the perimeter securing the two sides of the zipper that are now facing inward. When the perimeter of this invention is being sewn together, the small end is left open. A pouch is now formed with the two sides of the zipper facing inward and the two patterns or colors to be used facing each other. By using the opening at the small end, the pouch is turned inside out, thus the two patterns of colors are no longer facing each other and the two sides of the reversible zipper are now facing outward. The outline of a standard necktie is then sewn in the center of this necktie structure, which now appears like a flattened pouch. Once the outline has been sewn using clear or invisible thread this invention can now be folded back in either direction and folding at the same place each time. The small end is now sewn together and a tab with a buttonhole is placed over the stitch lines with a button or clasps or any other device that may be used to attach a tab to a necktie structure with the ability to pivot from left to right.

The nametag is now attached to this invention by the use of buttons, clasps, or hook-and-loop fasteners. The buttons are attached to my invention by using thread. A hook-and-loop fastener may be attached to my invention by using buttonholes and securing it around the buttons that are already secured by thread. The nametag is only attached on one end until this invention is zipped up. There is a nametag on both patterns. Once my invention is zipped up, the nametag on the pattern or color to be worn is then attached at both ends. When the two sides of the reversible zipper are attached and zipped up and the nametag on the pattern of color to be worn outward is fully attached, the necktie is ready to be tied and worn.

What is claimed is:

1. A reversible necktie structure, comprising:

a generally flat planar member having a first face and a second opposite face, said planar member having opposite lateral flaps and a length sufficient for being tied into a necktie;

a releasable attaching mechanism configured on respective outboard sides of each of said lateral flaps fold lines defined in said planar member delimiting said lateral flaps;

said lateral flaps foldable along said fold lines in a first direction and joined together at a back side with said releasable attaching mechanism such that said first face defines a front outward face of a first necktie configuration; and wherein said lateral flaps are foldable along said fold lines in a second opposite direction and joined together at a back side with said releasable attaching mechanism such that said second face defines front outward face of a second necktie configuration.

2. The reversible necktie configuration as in claim 1, wherein said releasable attaching mechanism comprises a reversible zipper having a zipper strip attached to said respective outboard edges of each of said lateral flaps, at least one of said zipper strips including a zipper clasp.

3. The reversible necktie configuration as in claim 1, wherein said fold lines are defined by stitching in said planar member.

4. The reversible necktie configuration as in claim 3, wherein said stitching is made with generally clear thread material.

5. The reversible necktie configuration as in claim 1, wherein said planar member comprises a first material joined to a second material along a perimeter of said planar member.

6. The reversible necktie configuration as in claim 1, further comprising a tab member disposed so as to extend from a narrower longitudinal end of said planar member, said tab comprising a button hole for releasable attachment to a button of a wearer's shirt in either of said necktie configurations.

7. The reversible necktie configuration as in claim 6, wherein said tab is pivotally attached to said planar member so as to pivot with movement of said planar member when said tab is attached to a wearer's shirt.

8. The reversible necktie configuration as in claim 1, further comprising a reversible nametag attachable across said lateral flaps in either of said necktie configurations.

9. The reversible necktie configuration as in claim 8, wherein said nametag is removably attached to at least one of said lateral flaps.

10. A reversible necktie structure, comprising:

a generally flat planar member having a first face and a second opposite face, said planar member having opposite lateral flaps and a length sufficient for being tied into a necktie;

a reversible zipper having a zipper strip attached to respective outboard edges of each of said lateral flaps, at least one of said zipper strips including a zipper clasp;

fold lines defined in said planar member delimiting said lateral flaps, said fold lines defined by stitching;

said lateral flaps foldable along said fold lines in a first direction and joined together at a back side with said reversible zipper such that said first face defines a front outward face of a first necktie configuration; and wherein said lateral flaps are foldable along said fold lines in a second opposite direction and joined together at a back side with said reversible zipper such that said second face defines a front outward face of a second necktie configuration.

* * * * *